United States Patent [19]

Looney

[11] Patent Number: 5,033,731

[45] Date of Patent: Jul. 23, 1991

[54] DUAL MODE STACK HEIGHT AND SHEET DELIVERY DETECTOR

[75] Inventor: John H. Looney, Fairport, N.Y.

[73] Assignee: Xerox Corporation, Stamford, Conn.

[21] Appl. No.: 491,923

[22] Filed: Mar. 12, 1990

[51] Int. Cl.[5] ..... B65H 7/02

[52] U.S. Cl. ..... 271/176; 271/188; 271/207; 271/220; 271/258

[58] Field of Search ..... 271/199, 188, 207, 220, 271/213, 215, 258, 259, 176

[56] References Cited

U.S. PATENT DOCUMENTS

| | | | |
|---|---|---|---|
| 3,647,045 | 3/1972 | Wegener | 271/207 |
| 4,469,319 | 9/1984 | Robb et al. | 271/3.1 |
| 4,475,732 | 10/1984 | Clausing et al. | 271/10 |
| 4,589,645 | 5/1986 | Tracy | 271/3.1 |
| 4,789,150 | 12/1988 | Plain | 271/220 |
| 4,824,091 | 4/1989 | Knight | 271/207 X |
| 4,934,683 | 6/1990 | Ueda et al. | 271/199 X |

FOREIGN PATENT DOCUMENTS

| | | | |
|---|---|---|---|
| 35707 | 3/1980 | Japan | 271/207 |
| 206769 | 9/1986 | Japan | 271/215 |
| 116460 | 5/1987 | Japan | 271/213 |
| 116470 | 5/1987 | Japan | 271/207 |
| 60872 | 3/1988 | Japan | 271/215 |
| 66060 | 3/1988 | Japan | 271/207 |
| 112368 | 5/1988 | Japan | 271/207 |
| 295364 | 12/1988 | Japan | 271/207 |
| 117165 | 5/1989 | Japan | 271/207 |
| 1404401 | 8/1975 | United Kingdom | 271/215 |

OTHER PUBLICATIONS

"Auto Stapler Folder", Auto Stapler-II Service Manual Revision O, Canon, May 1989, Fy8-13A3-000.

*Primary Examiner*—Robert P. Olszewski
*Assistant Examiner*—Boris Milef

[57] ABSTRACT

In a sheet stacking control system for a printer or copier in which sheets are sequentially fed by a sheet output for stacking in a stacking tray up to a desired preset maximum stacking level, a plural mode stack height sensing and sheet delivery detection apparatus in which a common sensor with a common actuating member is actuated by a sheet being fed by the sheet output to provide a first intermittent signal, and this same plural mode apparatus is also actuated to provide a second signal in response to the stack of sheets in the tray approaching a desired preset maximum stacking level. The first and second signals from the common sensor are distinguishable signals, so that the first, intermittent, signal is interpreted as a count of the number of sheets being outputted, and the second, continuous, signal is interpreted as a full tray condition or a sheet jam, and this second signal can provides a control signal for stopping the production or outputting of further sheets to that output tray. The actuating member is preferably an elongated light weight pivotal arm normally angularly extending across the sheet output path and down into the stacking tray to normally rest with its outer end on top of the stack of sheets except when pivoted up by another sheet being fed into the tray. Corrugating and downward pressure on the sheet being outputted upstream of the exit rolls cooperatively resists both premature sheet lead edge drooping over the stack and the weight of the actuating arm, which arm weight subsequently provides trail edge sheet settling or knockdown assistance once the trail edge of the sheet is released by the exit rolls.

1 Claim, 2 Drawing Sheets

DUAL MODE STACK HEIGHT AND SHEET DELIVERY DETECTOR

Figure 1:
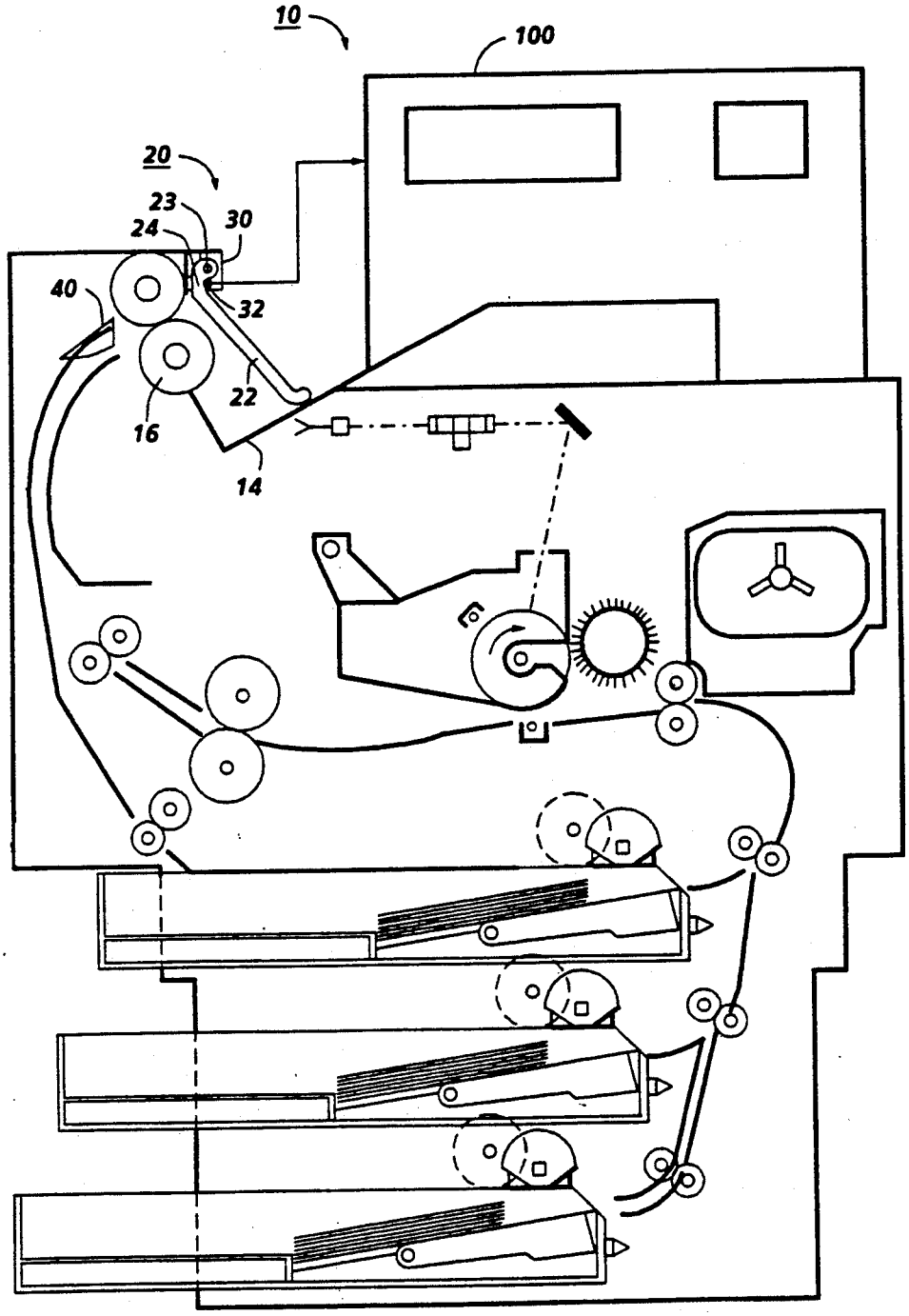

Cross-referenced for further details of the exemplary illustrated printer in the disclosed embodiment are two allowed applications of the same assignee by Denis J. Stemmle, application Ser. Nos. 07/357,926 and 07/359,064, both filed May 30, 1989, now U.S. Pat. Nos. 4,928,127 and 4,928,128, respectively. However, this embodiment is merely exemplary, and the plural mode sheet output stacking control system disclosed herein may be utilized in many other printers, copiers, or duplicators or the like.

The present invention relates to a plural mode sheet stacking control system. In the disclosed system the same, simple, low-cost, sensing or control apparatus can detect (for counting and/or control) each incoming sheet being stacked in a sheet stacking tray or the like, yet also provide a control signal positively indicative of the sheet stacking tray being filled to a desired maximum stacking level or capacity. This sheet stack height or thickness sensing function of the apparatus may be utilized to indicate that the stacking tray is full and/or that the sheet stack should be removed, and/or has been removed, and/or to stop the copier/printer, and/or to lower the stacking tray if an elevator is available, in response to such a signal. Additionally, the same plural mode sensing system can also assist in sheet restacking or trail edge knockdown assistance. A system of additional cooperative sheet corrugation for improved physical control of sheets being restacked is also disclosed herein.

By way of background, there is a long well known problem in copiers or printers with overstacking, or not providing for a sheet stacking capacity limit. As an overstacked condition is reached, the copy or print sheets on top of the stack can be mislocated. That is, by building a stack set too high relative to the sheet input or entrance level, additional entering sheets can push previous sheets off of the top of the stack. In a stacking system which provides offsetting or lateral offsetting into job sub-sets of the sheets being stacked, overfilling the tray and then continuing to load more sheets into it can cause sheet drag induced skewing of the previously stacked sheets and disturb the job subset integrity. Overstacking can also cause jams and/or curls of incoming sheets by dragging or catching the lead edge of the incoming sheet on the top of the stack, or other such problems.

One known prior art attempted solution to these overstacking problems is to provide a sensor or switch in the bottom of the stacking tray to detect the first sheet loaded thereon, and then to count or allow a preset number of subsequently inputted sheets thereafter. However, with that prior art system the total stack height is only an estimate, based on the counted total number of sheets ejected into the tray times an estimate of the sheet thickness. The actual sheet and stack thickness will vary with the basis weight of the copy sheets, sheet curl, etc.. Also, such sensors in the tray bottom can be fooled by room light, or a dark image on the bottom of the sheet, or by the hand of the operator accidentally passing through the sensing area of an empty tray. Also, copier or printer operators or users tend to remove only their own jobs from the total stack, leaving the remainder of the stack in the tray, and even replacing the rest of the stack back into the tray. The latter fools the tray switch into generating an "empty" or "cleared bin" signal and thus allows the stack to continue to build to over-capacity. This partial set removal is a particular problem for a shared or multi-user printer.

Further by way of background, it will be appreciated that in general some copy sheet systems have been provided with an apparatus or system for counting or sensing the incoming or outgoing copy sheets, and separate apparatus for detecting or indicating a stack height in some manner. U.S. Pat. No. 4,475,732 issued Oct. 9, 1984 to Don Clausing, et, al. is one example of a stack height adjustment utilizing an optical switch or optical sensor occlusion system 86, 88. However, this an input stack feeder, from which fresh sheets are being sequentially fed out, rather than printed output sheets being stacked therein. U.S. Pat. No. 4,589,645 issued May 20, 1986 to Michael Tracy shows a set separating finger which includes optical sensor occlusion or non-occlusion by extensions or flags of the separator finger for detecting and signaling stack height. However, this is a recirculating document handler in which the incoming sheets are original documents being copied and restacked on top of the finger, and the finger is designed to drop down through the bottom of the tray in response to all the sheets being fed out from the bottom of the stack under the finger. Also this U.S. Pat. No. 4,589,645 separate finger is not located in the sheet restacking entrance path to the tray.

By way of background for a document corrugator for assisting in restacking especially large documents sheets in a document tray of a recirculating document handler, with corrugation ramps above the sheet path, there is disclosed U.S. Pat. No. 4,469,319 issued Sept. 4, 1984, to Frank Robb, et. al..

Sheet trail edge flexible knockdown assistance flaps for sheet restacking control are disclosed in this U.S. Pat. No. 4,469,319, and also in U.S. Pat. No. 4,789,150 issued Dec. 6, 1988 to M. Plain. All of the above-cited patents are assigned to Xerox Corporation.

Referring to the disclosed embodiment, the desired plural functions may all be accomplished as shown by the disclosed plural mode stack height and sheet delivery detector system. In this disclosed system, a light weight pivotal actuating arm is extending across the copy sheet output exit path and also normally further extending down into the output stacking tray to normally rest on top of the stack of sheets being stacked in said output tray. As each sheet is fed into the tray entrance area or exit path it can freely push up this light weight arm into a sheet delivery detection position, in which position an extension or flag of the arm functions to actuate or not actuate (occlude or not occlude) an optical sensor providing an output signal indicative of an incoming sheet. As the trail edge of the sheet is ejected into the output stacking tray, this arm can help to push the tray edge area of the sheet down to provide a knockdown or stacking assist. Thus, as the stack fills with sheets, a signal is provided for each incoming sheet. Yet another signal can be provided, of the tray or stack "full" condition, using the same apparatus. When the arm "rest" position on the top of the stack rises above a pre-set level, the same or another sensor can be actuated by the same (or another) extension or flag of the arm to indicate the desired stacking level has been reached. As shown, a single sensor may be utilized, which is momentarily actuated by the input of each sheet, but which is continuously actuated when the stack is full. Thus, by connection to a suitable copier/-controller, the intermittent signal can be readily interpreted as a count of an incoming sheet, and the continuous or steady state signal can be interpreted as either a stack full condition, or a sheet jam. In either case the latter signal can desirably be used to stop the production or output of further prints or copies, or to switch the output to another output tray or bin. Alternatively, if the output tray is a known elevator type, the tray may be lowered in response to this latter signal to accommodate the stacking of further output copy sets when the desired stacking height (stack top level) relative to the output level is exceeded. See, e.g., U.S. Pat. No. 4,834,360 FIG. 4,4,801,135, 4,189,133, 4,189,270, or pending Xerox Corporation App. Ser. No. 07/076,979.

A specific feature of the specific embodiment disclosed herein is to provide a sheet stacking control system for a printer or copier in which sheets are sequentially fed by sheet output means for stacking in a stacking tray up to a desired preset maximum stacking level; with an improved sheet stacking control system comprising a plural mode stack height sensing and sheet delivery detection apparatus in which a common sensing means with a common actuating member is actuated by movement of said actuating member by a sheet being fed by sheet output means to provide a first intermittent signal for sheets being outputted by said sheet output means to be stacked in said stacking tray, and wherein said same plural mode stack height sensing and sheet delivery detection apparatus is also actuated by the position of said actuating member relative to said stacking sheets in said stacking tray to provide a second signal in response to said stacking sheets in said stacking tray approaching said desired preset maximum stacking level, and wherein said common sensing means provides distinguishable signals for said first intermittent signal for sheets being outputted by said sheet output means versus said second signal in response to said stacking sheets in said stacking tray approaching said desired preset maximum stacking level.

Further specific features provided by the system disclosed herein, individually or in combination, include those wherein the sheet stacking control system and said actuating member is an elongated pivotal actuating arm extending across the sheet path of said sheet output means into said stacking tray for pivotal actuating movement of said actuating arm by a sheet being fed by said sheet output means into said stacking tray to actuate said common sensing means to provide said first signal, and wherein said pivotal actuating arm also normally further extends down into said stacking tray to normally rest on top of the stack of sheets stacking therein except when so pivoted by a sheet being fed by said sheet output means into said stacking tray, and/or wherein said second signal is provided in response to said pivotal actuating arm normally resting on top of the stack of sheets stacking in said stacking tray at a preset pivotal angle corresponding to said desired preset maximum stacking level, at which preset pivotal angle of said pivotal actuating arm said pivotal actuating arm at least semi-continuously actuates said common sensing means to provide said second signal, and/or wherein said pivotal actuating arm also functions to assist in the trail edge area stacking of sheets stacking in said stacking tray by helping to push down towards the top of said stack the trail edge area of a sheet fed by sheet output means to be stacked in said stacking tray by said pivotal actuating arm being biased towards and pivotal towards a trailing edge stacking portion of the bottom of said stacking tray, and/or wherein said common sensing means has a common optical sensor and wherein said common actuating member is a light weight pivotal but elongated actuating arm angularly extending across the sheet path of said sheet output means and further extending down into said stacking tray to normally rest on top of the stack of sheets being stacked in said stacking tray, wherein each sheet being fed into said stacking tray can freely temporarily push up said light weight actuating arm towards a raised sheet delivery detection position which causes a flag extension of said arm to momentarily actuate said optical sensor to provide said intermittent first signal indicative of an incoming sheet, and/or wherein after the trail edge of a sheet is ejected from said sheet output means into said stacking tray, said actuating arm pushes the trail edge area of that sheet down from said raised sheet delivery detection position to provide a sheet knock-down stacking assist, and/or wherein the normal position of said actuating arm is with the outer end thereof resting lightly on top of the stack of sheets in said stacking tray, and wherein said second signal is generated to provide a full tray condition indicia whenever said actuating arm rest position on the top of the stack rises above a pre-set level at which a flag extension of said arm continuously actuates said common sensing means to indicate the desired stacking level has been reached, and/or wherein with a common connection to said common sensing means said first intermittent signal is interpreted as a count of the number of sheets being outputted, and said second continuous signal is interpreted as a full tray condition or a sheet jam condition and said second signal provides a control signal for stopping the production or outputting of further sheets to that output tray, and/or wherein said sheet output means partially supports a sheet being fed into said stacking tray until the sheet is fed therethrough and released for stacking, and wherein said actuating arm rides with a light downward force on top of a sheet being outputted by said sheet output means at a position slightly downstream of said sheet output means so that when the trail edge of a sheet being outputted by said sheet output means is released by said sheet output means, said actuating arm provides trail edge sheet settling or knock down assistance; and/or further including sheet corrugating means for exerting downward pressure on a sheet being fed into said stacking tray from a position upstream of said sheet output means for cooperatively resisting both premature sheet lead edge drooping over the stack and said light downward force on top of the sheet by said actuating arm until the trail edge of the sheet is released by said sheet output means for stacking.

All references cited in this specification, and their references, are incorporated by reference herein where appropriate for appropriate teachings of additional or alternative details, features, and/or technical background.

Figure 2:
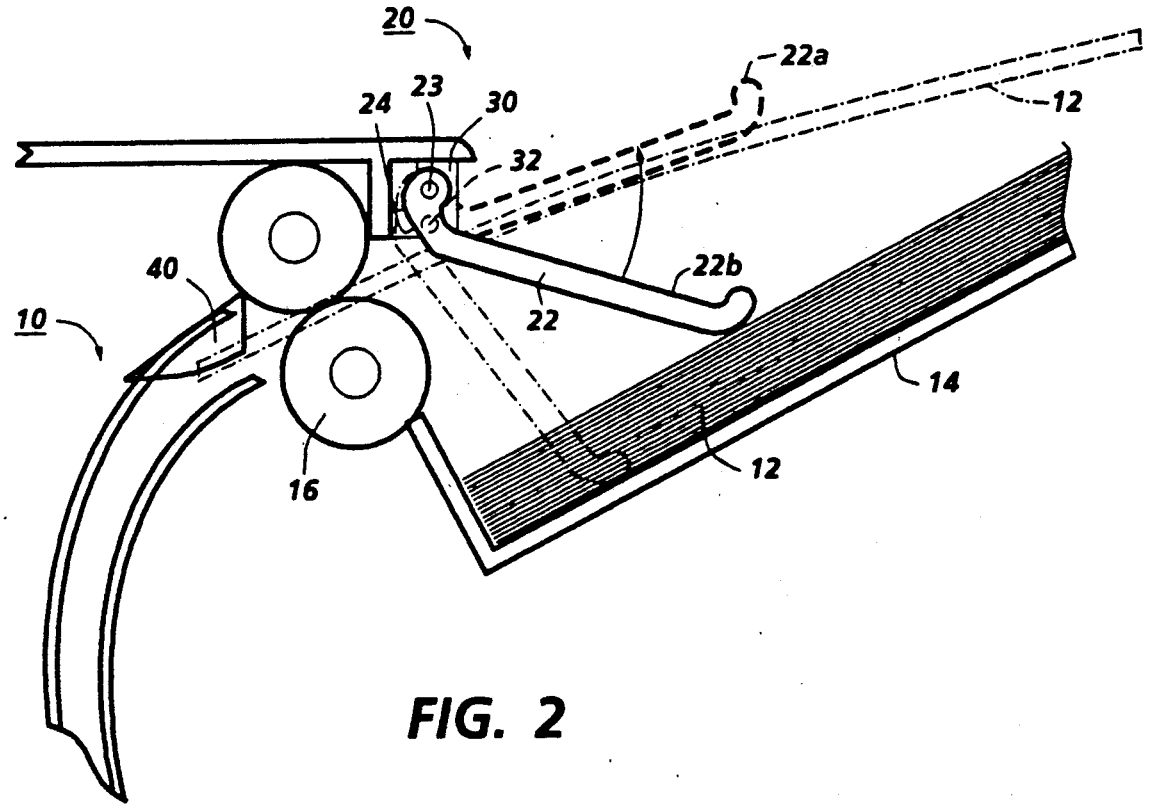

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

FIG. 1 is a schematic side view of one embodiment of an exemplary printer incorporating the subject plural mode stack height and sheet delivery detector system at its output, showing the output tray empty; and FIG. 2 is an enlarged view of said output and its plural mode stack height and sheet delivery detector system of FIG. 1, with an exemplary "full" stack height position 22*b* of the actuating arm 22 shown in solid lines, an empty tray position of the arm shown in light dot-dashed lines, and an exemplary sheet delivery detection position 22*a* for an entering sheet shown in heavy dashed lines.

The exemplary printer 10 illustrated in FIG. 1 is further described in detail in either of the cross-referenced allowed applications cited at the beginning of the specification. It need not be disclosed in any detail herein in any case since the subject system relates only to the copy sheet exit and stacking area disclosed there and especially in FIG. 2. The subject subject plural mode stack height and sheet delivery detector system, or sheet control and stacking system, may be utilized with almost any copier or printer in which cut sheet output is being accumulated or stacked in a tray or bin.

Describing now in further detail the exemplary embodiment with reference to the Figures, there is shown a duplex printer reproducing machine 10 merely by way of one example of a sequential source of sheets 12 to be stacked in an exemplary output tray 14. The sheets 12 are sequentially ejected for stacking therein by conventional exit feed rollers 16.

As better shown in FIG. 2, incorporated in this output area is an example of the subject plural mode stack height and sheet delivery detector system 20. The system 20 here includes an elongated actuating arm 22 pivotally connected at 23 to swing in a large pivotal arc. As shown in solid lines in FIG. 2, the arm 22 normally rests by gravitational force on the top sheet of the stack of sheets already stacked in output tray 14. This is the stack height sensing position. the arm 22 in that position extends across the sheet entrance path into the tray 14 as each sheet is fed through the nip of exit feed rollers 16. (This may also be referred to as the sheet exit path of the machine 10). Thus the lead edge of each entering sheet 12 to be stacked pushes forward and lifts up the pivotal arm 22 to the exemplary raised sheet delivery detection position 22*a* shown in dashed lines, in which the arm is temporarily sliding on top of the entering sheet 12 and is temporarily held up by that sheet, uncovering the light beam 32.

In a switch 30 example here, which is merely one example, this pivotal movement of arm 22 up to position 22*a* by an incoming sheet 12 causes an opaque upper extension portion or flag area 24 thereof to only momentarily briefly pass through and interrupt or occlude the light beam 32 of a conventional optical sensor or switch 30. Once the arm 22 reaches the fully raised position 22*a* the light beam 32 is not occluded. Then, after the trail edge of that sheet passing under the raised arm 22 is released by the nip of the exit feed rollers 16, that sheet is free to drop down on top of the stack, and then the arm 22 is free to drop back down from position 22*a* to its normal position with the outer end of arm 22 resting on top of the stack. In fact, the arm 22 helps push down the incoming sheet 12, at its trail edge area near the rear of the stack, and thereby assist in the stacking of that sheet as well as the sheets thereunder. This downward arm 22 movement also provides a brief intermittent electrical signal from sensor 30, after a time period following the first intermittent signal corresponding to the sheet feed-in time, unless there was a sheet jam or machine shutdown. These brief signals are readily discriminated from a longer time period signal by a conventional preset time or clock count or the like, in connecting controller 100. Comparative time periods may be set based on the maximum sheet 12 dimension and movement velocity. That tells the connecting control circuity and/or software 100 that one sheet is being outputted, but that the stack is not yet too high (the tray 14 is not yet too full).

The switch 30 example here is shown cut away for drawing clarity. Only one side of the conventional U-shaped channel of the conventional LED emitter-photodiode detector pair of the optical sensor 30 through which the flag 24 moves to interrupt the light beam 32 therebetween is illustrated here.

As tray 14 fills with outputted sheets, the stack top level rises, and the normal or rest position of the outer end of arm 14 on top of the stack correspondingly rises. At a selected preset "full tray" or "stack full" position 22*b* at a desired height of (pivotal angle of) the arm 22, the same [or another, if desired] flag area 24 of the arm 22 will now steadily interrupt the same light beam 32 in the rest position of arm 22 on top of the stack. Thus, in this "full tray" condition this actuation of the switch 30 is continuous. [Except for a possible brief interruption during a sheet in-feeding, if another sheet is allowed to be fed in.] This continuous, or semi-continuous, signal, from the same sensor 30, using the same apparatus, provides a "full stack" or "full tray" signal. This signal is readily detected or distinguished as a different signal or indicia from the above-described brief-duration intermittent "sheet input" signal by its time duration, in a similar or other well known manner to that described above.

To express the above-described sheet delivery detection function in other words, the sheet entering the exit tray first pushes the actuating arm 22 out of the way and then supports that arm briefly at raised position 22*a*. The actuating arm 22 then drops to its normal position resting on top of the stack once the trail edge of the sheet has dropped to the stack level. That returns the flag or actuating portion 24 of the actuating arm 22 back to its normal position in the sensor 30 body. The movement of this flag embodiment 24 only intermittently covers the detector 30 actuating beam 32. That is, the rotation of the actuating arm 22 from its raised sheet entrance position to the normal stack height position and vice versa rotates or passes by the emitter/detector beam 32 of the optical sensor 30 to give an intermittent occlusion or actuation signal. The time period between these brief actuations of the sensor 30 corresponds approximately to the period of time for the delivery of each sheet to the tray plus a short initial sheet settlement or stacking time.

To now express in other words the other main function, the above-described stack height detection function, after the stack level has reached its desired height within the tray, the actuating flag 24 of the arm 22 at this position 22*b* is no longer able to drop past the sensor 30 position, and thus the sensor 30 beam 32 is blocked for a much longer period of time, corresponding to at least the period of time between the delivery of sheets to the tray. This signals that the desired tray stacking limit has been reached or approached. That longer duration signal may be utilized to initiate appropriate operator signals or displays and/or shut down the printer or copier sheet output, or actuate a tray elevator motor if one is provide [but a simple, low cost fixed tray, as shown, is preferred], or switch the output to another tray or bin if more than one is provided.

It will be appreciated that by different configurations or positions of the flag or extension 24 of the actuating arm, or by using more than one flag, or by using an apertured or notched flag, that different actuating/non-actuating sequences of a switch or sensor may be utilized for the same basic results in the same basic actuating arm system. Thus, for example, an alternative flag design could be provided in which the flag is an extension on the other side of the actuating arm and occludes the sensor except when a sheet is entering, and except when the stack height is such as to pivot the flag out of occlusion of the sensor.

The actuating arm 22 does not interfere with unloading the stack, since it rests on or contacts the stack near the inside or trail edge of the stack, and only engages the stack with a relatively light weight, and preferably with a smooth low-friction surface. However, even the relatively light weight of the actuating arm resting on the top of the stack can help push down curled up rear edges of the stacked sheets.

Although purely gravity movement of the actuating arm 22 is described here, it will be appreciated that a slight spring force can also be employed to bias the end of the arm down toward the stack, if desired.

The actuating arm 22 is preferably mounted and shaped so that it can be rotated upward to at least an approximately "12:00 o'clock" or horizontal position without hitting any stops, as shown. The arm 22 is preferably provided with a large pivot angle and extension so that the end of the arm 22 can pivot all of the way down to the bottom of a empty large sheet capacity (deep) output tray, as shown in phantom in FIG. 2, yet be capable of pivoting up to a much higher level **22*b* corresponding to the maximum desired height of the stack in the tray, and pivot even higher to as position 22*a* above the sheet input level when a sheet is entering the tray. Preferably the incoming lead edge of the sheet can impact the arm at a downwardly inclined angled surface thereof anywhere between these two extremes. Thus, an arm 22 length greater than the tray depth is preferred. That is, an arm 22 longer that the distance from the switch 30 above the sheet entry level to a point on the tray bottom slightly spaced out from the rear wall of the tray is preferred. That way the initial position of the arm is always at a downwardly inclined angle. The preferred choice of a tough plastic, such as ABS, assures that the actuating arm 22** will be resistant to damage and wear.

Additionally disclosed is a cooperative method of corrugating the sheet being ejected, preferably by corrugating the sheet from above by plural corrugating members 40 extending down into the sheet path from a point on the sheet path preceding (upstream of) the nip of the exit rollers 16. These corrugating members 40 may be fixed inclined ramp surfaces, transversely spaced apart across the sheet path, as shown for example in the above-cited U.S. Pat. No. 4,469,319-see reference Nos. 84–89. This corrugation system helps control the paper sheet trajectory into the catch tray by increasing the beam strength of the sheet being stacked, to resist drooping from the sheets weight and the downward force of the arm 22 until the trail edge of the sheet clears the exit rollers 16 nip. This corrugation also adds drive force by pushing stiff paper harder against the exit rollers 16. The actuator or sensing arm 22 function herein is assisted or enabled by this sheet corrugation arrangement.

An additional advantage or function of this preferred corrugation system 40 in cooperation with the stack sensing and control system 20 herein is that the resultant delay in the curl down or droop of the lead edge of the sheet being restacked delays the onset of lead edge drag of the incoming sheet against the top of the stack. This delay in lead edge drop is due not only to the increased beam strength arising from the sheet corrugation, but also from the effective sheet supporting cantilever, force couple, or moment arm force generated by the corrugators 40 in cooperation with the exit rollers 16 spaced downstream therefrom. The corrugators 40 are pushing down on the top of the incoming sheet 12 behind or rearwardly of the exit rollers 16 nip, where simultaneously the same sheet is being supported and held up in this exit rollers nip. This support or lifting of the corrugated sheet resists the drooping tendency of the sheet and the sensing arm 22 weight until the trail edge of the sheet is released by the exit rollers nip.

The disclosed apparatus and system may be readily connected into various conventional control systems 100 or the like for copier or printers for various functions, including those described above. Conventionally programmed microprocessor systems connecting with the various sheet detecting switches, sensors, etc., are disclosed in various U.S. patents, including U.S. Pat. No. 4,475,156, etc.. The software, of course, will vary depending on a particular desired function and the particular software operating system and the particular microprocessor or microcomputer system being utilized. However, it is well known in the art how to do such programing with general knowledge in the software and computer arts. Of course, controls may alternatively provide utilizing various known or suitable hardwired logic or switching systems.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet stacking control system for a printer or copier in which sheets are sequentially fed by sheet output means for stacking in a stacking tray up to a desired preset maximum stacking level;

an improved sheet stacking control system comprising a plural mode stack height sensing and sheet delivery detection apparatus in which a common sensing means with a common actuating member is actuated by movement of said actuating member by a sheet being fed by sheet output means to provide a first intermittent signal for sheets being outputted by said sheet output means to be stacked in said stacking tray, wherein said same plural mode stack height sensing and sheet delivery detection apparatus is also actuated by the position of said actuating member relative to said stacking sheets in said stacking tray to provide a second signal in response to said stacking sheets in said stacking tray approaching said desired preset maximum stacking level, wherein said common sensing means provides distinguishable signals for said first intermittent signal for sheets being outputted by said sheet output means versus said second signal in response to said stacking sheets in said stacking tray approaching said desired preset maximum stacking level, wherein said common actuating member is a light weight pivotal but elongated actuating arm angularly extending across the sheet path of said sheet output means and further extending down into said stacking tray to normally rest on top of the stack of sheets being stacked in said stacking tray, wherein each sheet being fed into said stacking tray can freely temporarily push up said light weight actuating arm towards a raised sheet above said maximum stacking level which causes an extension of said arm to momentarily actuate said common sensing means to provide said intermittent first signal indicative of an incoming sheet, wherein said second signal is provided in response to said pivotal actuating arm resting on top of the stack of sheets in said stacking tray at a preset pivotal angle corresponding to said desired preset maximum stacking level, at which preset pivotal angle of said pivotal actuating arm said pivotal actuating arm at least semi-continuously actuates said common sensing means to provide said second signal, and wherein said pivotal actuating arm also functions to assist in the trail edge area stacking of sheets stacking in said stacking tray, by helping to push down towards the top of said stack the trail edge area of a sheet fed by sheet output means to be stacked in said stacking tray, by said actuating arm being biased towards and pivotal towards a trailing edge stacking portion of the bottom of said stacking tray, and by said actuating arm riding with a light downward force on top of a sheet being outputted by said sheet output means at a position slightly downstream of said sheet output means so that when the trail edge of a sheet being outputted by said sheet output means is released by said sheet output means for stacking, said actuating arm provides trail edge sheet settling or knock down assistance, but wherein said sheet output means partially supports a sheet being fed into said stacking tray until the sheet is fed therethrough and released for stacking by said sheet output means including sheet corrugating means for exerting downward pressure on a sheet being fed into said stacking tray from a position upstream of said sheet output means for cooperatively resisting both premature sheet lead edge drooping over the stack and said light downward force on top of the sheet by said actuating arm until after the trail edge of the sheet is released by said sheet output means for stacking.

* * * * *